FIP7811 OR 4,088,368

United States Patent [19]

Lavon et al.

[11] 4,088,368

[45] May 9, 1978

[54] METHOD FOR EXPLOSIVE BREAKING OF HARD COMPACT MATERIAL

[75] Inventors: Erik Volmar Lavon, Saltsjö-Boo; Levi Johannes Karlfors, Nacka, both of Sweden

[73] Assignee: Atlas Copco Aktiebolag, Nacka, Sweden

[21] Appl. No.: 720,734

[22] Filed: Sep. 7, 1976

[30] Foreign Application Priority Data

Sep. 19, 1975 Sweden ..... 7510558

[51] Int. Cl.[2] ..... E21C 37/12; F42D 3/04

[52] U.S. Cl. ..... 299/13; 102/23; 175/3.5

[58] Field of Search ..... 299/13, 16; 102/22, 102/23; 175/3.5; 166/177, 299

[56] References Cited

U.S. PATENT DOCUMENTS

| | | | |
|---|---|---|---|
| 3,002,454 | 10/1961 | Chesnut | 166/299 |
| 3,877,373 | 4/1975 | Bergmann et al. | 299/13 X |

*Primary Examiner*—Ernest R. Purser

*Attorney, Agent, or Firm*—Flynn & Frishauf

[57] ABSTRACT

A hard compact material, such as rock, is broken by delivering an explosive into at least one hole which has been pre-drilled in the material to be broken and by forcing a relatively incompressible fluid, such as water, into the hole to impact the explosive to initiate same. Upon detonation of the explosive the fluid stems the hole thereby delaying leakage of blasting gases out of the hole before the material is broken. Preferably, the explosive and the fluid are launched together into the hole. In this case may the explosive and the fluid be encapsulated in a common cover.

11 Claims, 7 Drawing Figures

METHOD FOR EXPLOSIVE BREAKING OF HARD COMPACT MATERIAL

This invention relates to a method and a device for breaking a hard material, such as rock, wherein at least one hole is drilled in the material to be broken and a blasting charge is loaded therein whereupon the charge is initiated.

These operations are to be carried out by means of equipment which can be kept all the time within the blasting area. The term blasting area denotes the space where the rock debris are thrown. This equipment which may comprise a rig usually provided with several rock drilling machines and loaders and mucking machines remains in the same position during all the operations or at least within the blasting area. This method of rock blasting, e.g. in tunneling and drifting, means a large saving of time. In conventional tunneling delays are considerable owing to the time required for moving the drilling equipment from the blasting area after the drilling and for moving it back to next working position after the blasting and mucking of the fragmentated rock. By limiting the number of charges in each blasting operation and by limiting the overall amount of the charge, i.e. by blasting in sequence, each blasting operation can be held within such dimensions that the equipment does not need to be withdrawn before each blasting.

A very frequent variant of this type of blasting is the so-called short delay blasting technique, wherein the number of simultaneously detonating charges in a large round is limited by successively initiating the charges electrically with delay interval between the charges.

This blasting technique in itself is known. In another variant only one or a few holes at a time are drilled and the ignition of the blasting charge is obtained by propagating the required energy through an inactive medium to the charge. Another typical example of such remotely actuated ignition is to project a bullet toward the blasting charge which is inserted into the drill hole thereby initiating the charge. This mode of ignition, however, does not satisfy the economic demands which must be met in order to reduce the technique into practice.

The invention seeks to improve the technique of cautious blasting thereby making it possible to closely upon each other drill, charge, blast and load while safeguarding ignition without any costly measures. This is achieved by supplying the energy required for initiating the detonation by means of the covering or stemming which is intended to stop up or stem the drill hole.

The invention is described in the following description with reference to the accompanying drawings in which various embodiments are shown by way of example. It is to be understood that these embodiments are only illustrative of the invention and that various modifications thereof may be made within the scope of the claims following hereinafter.

It is to be understood that the term "fluid" used in the claims means a substance that alters its shape in response to any force, that tends to flow or to conform to the outline of its container, and that includes liquids, plastic materials and mixtures of solids and liquids capable of flow.

In the drawings.

Corresponding details have been given the same reference numeral in the various figures.

Figure 1:
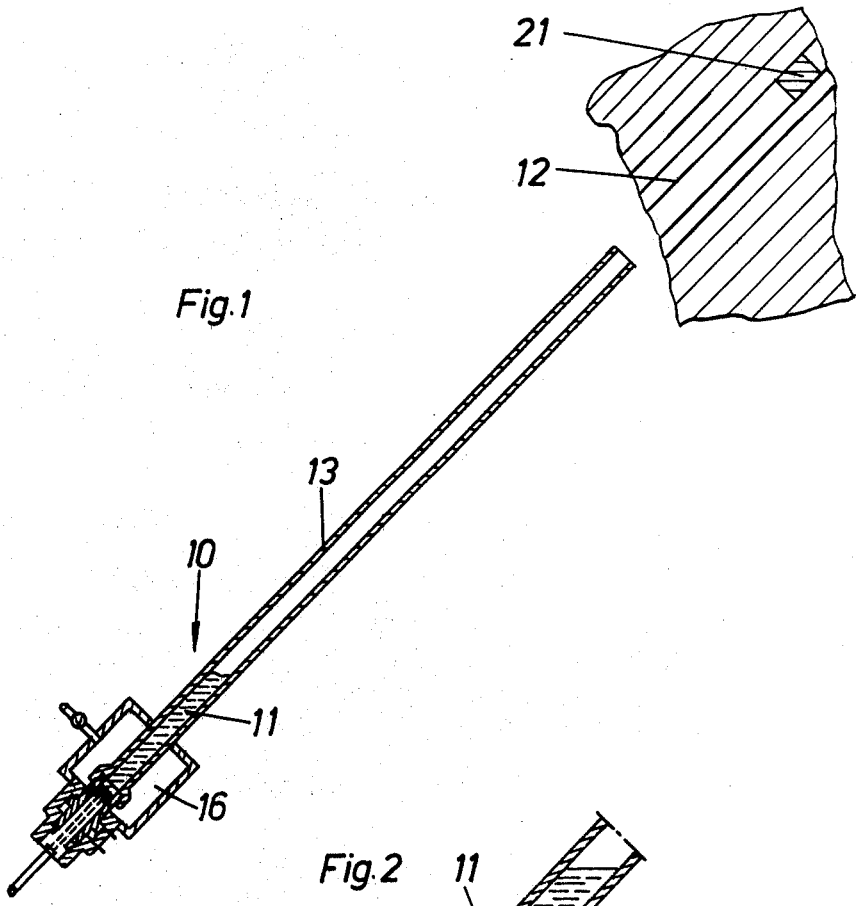
FIG. 1 is a sectional side view of an apparatus according to the invention.
Figure 2:
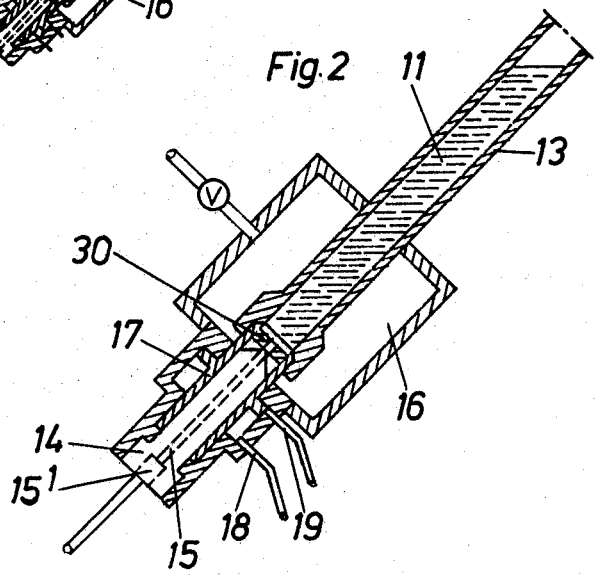
FIG. 2 is an enlarged section of a portion of the apparatus in FIG. 1.

In FIGS. 1 and 2 is shown a gun designated generally 10 for launching or projecting a stem or covering 11 into a pre-drilled cylindrical blind hole 12; said covering being intended to stop up or stem the drill hole. The hole 12 is drilled by using conventional technique. An explosive is inserted into the hole 12 and is packed therein. When the stem 11 is forced or projected into the hole 12 it strikes the explosive 21 thereby initiating the explosion. The stem 11 stops up the hole and prevents the generated detonation gases from leaking past the stem. The stem also prevents leakage of explosive out of the hole. The stem, thus, contributes to a maximum bursting effect. The accelerated stem is the active medium for supplying the energy required for initiation of the explosive. In order to eliminate the risk that detonation does not occur the speed of the stem must exceed a lower limit value when the stem strikes the explosive and delivers an impact thereagainst; said limit value being dependent on the type of explosive. In the illustrated embodiment the stem 11 consists of water; other fluids, however, may be used.

The gun 10 comprises a barrel 13. The barrel 13 is centered relative to the hole 12 having its mouth just in front of the opening of the hole. A back head 14 is screwed into the rear part of the gun 10. The back head 14 is provided with a passage 15 traversing therethrough. The fluid is filled into the barrel 13 through the passage 15. A check valve 15[1] in the passage 15 prevents the fluid from flowing out of the barrel 13. A charge chamber 16 for power fluid is arranged around the rear portion of the barrel 13. The power fluid which consists of pressure air or any other pressure gas is used for accelerating the stem. In FIGS. 1 and 2 a plate 30 is inserted between the power fluid and the stem 11. The plate 30 is intended to keep the stem unchanged in shape by preventing so-called fingers from arising which may occur when high pressure air is caused to act upon a water surface. The plate 30 may be inserted into the barrel 13 by unscrewing the back head 14. The water is then admitted through the passage 15 and a hole in the plate 30 which is concentric with the passage. Alternatively the plate 30 may be designed without any hole; in such case may the fluid be admitted through a conduit not shown which extends radially relative to the barrel 13. Under certain circumstances the plate 30 may be omitted. By making the stem 11 of sufficient length and by controlling the supply of pressure air in suitable manner by means of a valve slide 17 it is possible to limit the extension of the above-mentioned fingers thereby making it possible to accelerate the stem without using the plate 30. The valve slide 17 can be shifted by supplying control air to either of two passages 18, 19. By shifting the slide 17 from the position shown in FIG. 2 the pressure gas in the chamber 16 is caused to act upon the rear end face of the stem 11 via the plate 30. The stem 11, thus, is accelerated. A continued acceleration of the stem 11 occurs during its transport through the barrel 13 due to the expansion of the pressure gas in the chamber 16. When the accelerated stem leaves the barrel 13 it is launched into the hole 12. The volume of air in the barrel 13 in front of the stem 11 is vented through the gap between the barrel and the rock.

When the stem strikes the explosive a shock wave is generated in the stem. The smallest applicable length of the stem is defined by the time during which the pressure required for the initiation has to act upon the explosive in order to obtain detonation. On condition that the length of the stem is smaller than the depth of the hole or that the stem is forced into the hole through a tube having its mouth within the hole this time is equal to the time required for the shock wave (and thus the sound) to propagate forth and back through the stem 11. As a rule, however, the optimum length of the stem exceeds this smallest applicable length. The reason for this is that the depth of the hole as a rule exceeds the above defined smallest applicable length and that it is desired to completely fill the hole with the fluid in order to obtain the most efficient stemming.

The energy which is set free in the hole and which is made use of for the breakage of the material is composed of two components, namely the chemical energy of the explosive and the kinetic energy of the stem. The kinetic energy is a valuable additional contribution of energy to the blasting process and that means that the amount of explosive can be reduced when compared to conventional blasting. Besides a better overall blasting effect seems to arise due to the fact that the stem is a fluid which fills the produced cracks and therefor delays the leakage of the blasting gases to the surroundings before complete breakage is caused.

In the apparatus shown in FIGS. 1 and 2 the hole 12 can be loaded by means of conventional loading equipment. Alternatively the loading can be carried out by means of the gun 10. In this case the passage 15 may be connected to a T-type valve, not shown; the valve having two inlets and an outlet connected to the passage 15. The inlets are connected to a pressure air source and a fluid source, respectively. The explosive 21, which in this case preferably is encapsulated, is inserted into the gun either from in front through the barrel 13 or from behind after unscrewing of the back head 14. The explosive 21 is loaded into the drill hole by means of pressure air whereupon the T-valve is shifted and the explosive packed by means of pressure fluid. In this case the stem 11 is driven against a fluid column in the hole 12 (provided that the hole 12 is directed downwards). The explosive is then initiated by means of the shock wave which is generated by the impact of the stem 11 against the fluid column and transmitted through the fluid column. Alternatively loading as well as packing can be performed by either pressure air or fluid.

Figure 3:
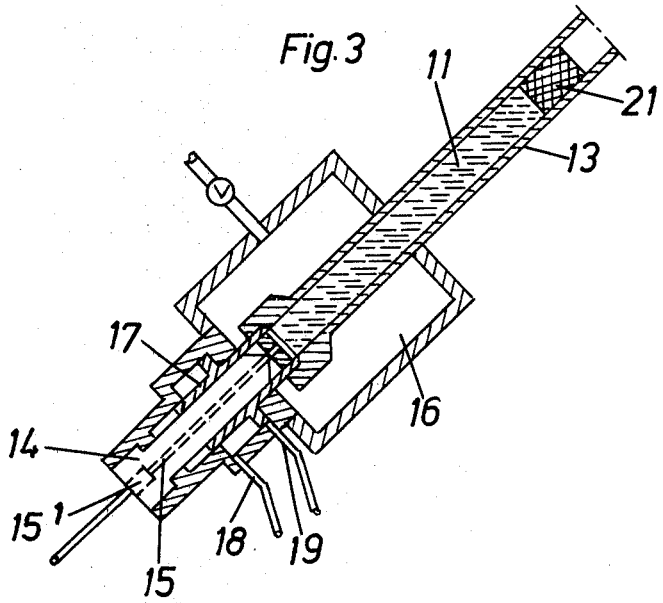
FIG. 3 illustrates an alternative way of using the apparatus in FIGS. 1 and 2.

According to a further development of the inventive conception loading as well as packing and initiating of the explosive can be carried out simultaneously by means of the stem 11. In FIG. 3 the gun 10 is shown ready to be fired. In this method the explosive and the stem advantageously, can be encapsulated in a common cover.

Figure 4:
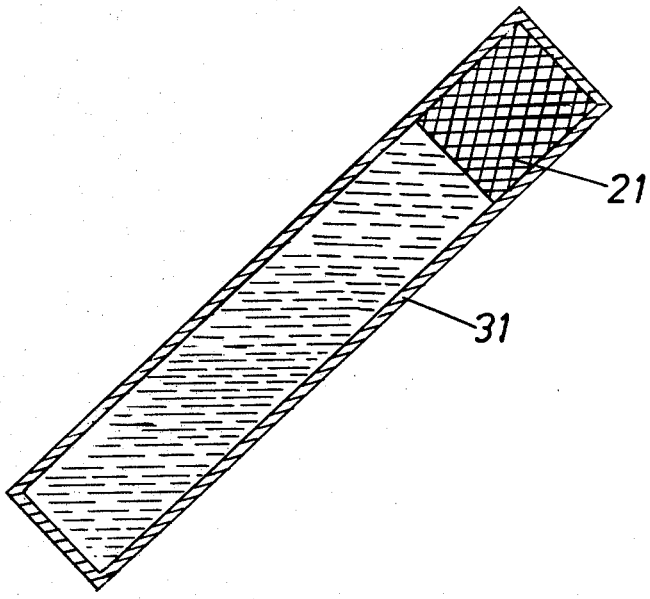
FIG. 4 shows an enlarged section of a projectile intended to be used in an apparatus according to the invention.

FIG. 4 discloses a projectile intended to be used in an apparatus according to the invention. The stem is encapsulated in a cover 31 which is launched into the pre-drilled hole. the cover should be made of a material which bursts easily due to the pressure which arises when the projectile strikes the bottom of the hole. Suitable materials are paper and plastics. The projectile may be modified such that it only partly is confined by a cover. The cover may comprise a rear limitation plate as shown in FIGS. 1–3 and a forward limitation plate. If the explosive is projected into the hole together with the stem the explosive may constitute the forward plate.

The essential new feature of the method according to the invention is that the charge is initiated by means of a relatively incompressible fluid which is accelerated and directed into the hole in form of a collected or coherent quantity which fills the hole. The initiation of the charge is then caused by the hammer action of the fluid against the charge. Due to the fact that the fluid fills the hole, i.e. its cross section area coincides substantially with that of the hole, the fluid provides the required stemming. If the explosive is not pre-packed, i.e. it is necessary to compress it, the fluid also carries out such compression.

Figure 5:
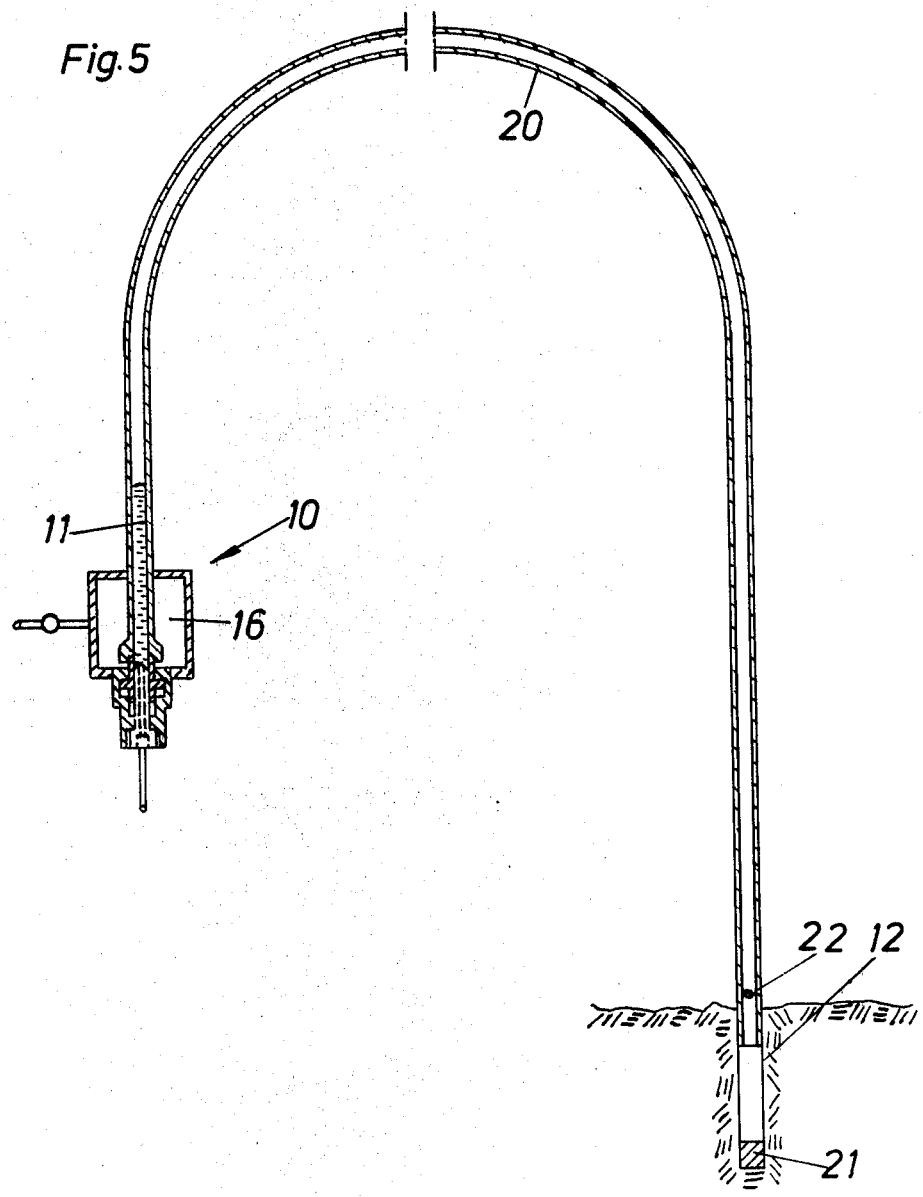
FIG. 5 shows another embodiment of an apparatus according to the invention.

When the additional contribution of energy derived from the kinetic energy of the stem is intended to be used for the breaking process the occurence of material crack formation in the material comparatively close to its surface means that a large quantity of fluid, i.e. a larger amount of energy, has to be supplied in order to compensate for the quantity which leakes through the cracks. In general it is desired that the cracks are initiated at the bottom of the hole and that they are propagating therefrom so as to loosen as much material as possible. This is safeguarded by inserting the barrel into the hole to about the half depth thereof. The propagation of the cracks which are in the vicinity of the bottom of the hole then take precedence since the fluid has to turn and overcome a flow resistance before it can reach the cracks which are outside the mouth of the barrel. Such a mode of breaking is illustrated in FIG. 5 which shows an embodiment of the invention wherein the hole 12 can be oriented arbitrarily relative to the gun 10. The barrel of the gun 10 is designed as a tube 20. The tube 20, preferably flexible, is inserted into the hole 12. The stem 11 is accelerated by means of the power gas in the chamber 16 toward the explosive 21 in the hole 12. The volume of air which is confined by the stem 11 and the explosive 21 is vented through a bore 22. Alternatively the venting may be carried out along the outside of the tube 20 between the tube and the wall of the hole. The tube 20 which consequently has an external diameter that is smaller than the diameter of the hole is suitably provided with outer centering flanges at least at its forward end. Besides along the outside of the tube 20 the venting may also be carried out through one or several openings in the tube 20. Venting may also be carried out by means of a device for air suction which is arranged around the tube 20 at the opening of the drill hole.

The apparatus shown in FIG. 5 can of course be used for loading and initiating in the same manner as is described above in connection with FIGS. 1–3.

Figure 6:
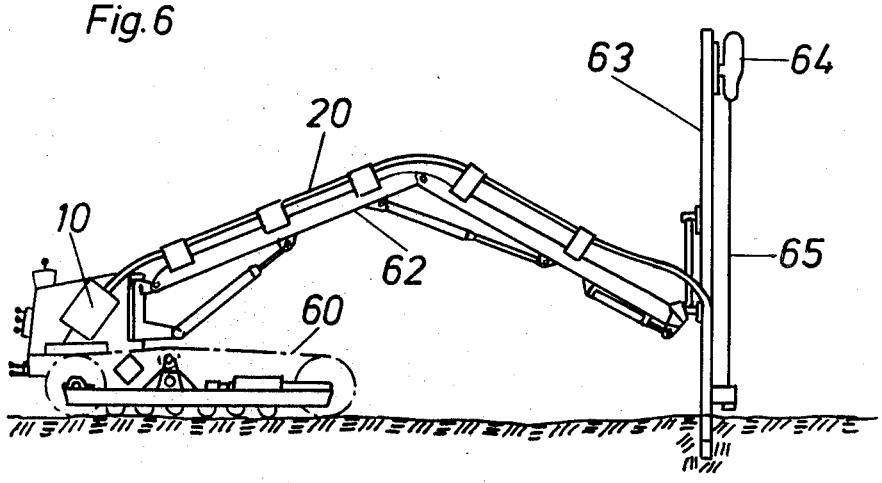
FIG. 6 shows diagrammatically a side view of a mobile rig carrying an apparatus according to the invention.
Figure 7:
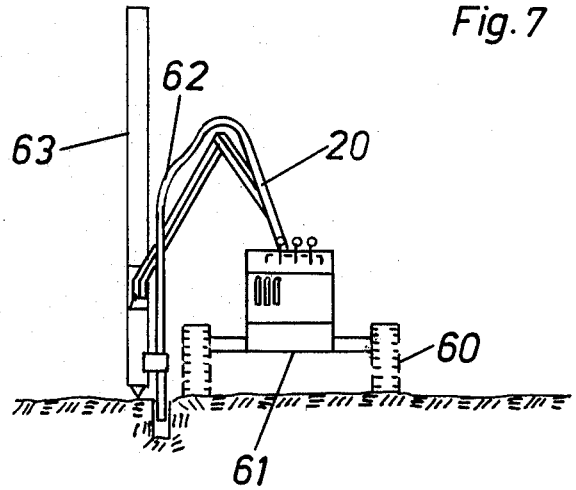
FIG. 7 shows diagrammatically a rear view of the rig in FIG. 6.

FIGS. 6 and 7 show diagrammatically a rig for carrying the device shown in FIG. 5. The rig comprises a chassis 61 provided with crawlers 60. The rig supports a folding boom 62 which can be swung as well as elevated and lowered relative to the chassis 61. The folding boom 62 carries a feed bar 63 at its free end. A mechanically fed rock drilling machine 64 is reciprocably guided along the feed bar. The rock drilling machine delivers impacts against a drill rod 65 during simultaneous rotation thereof.

The chassis 61 carries also the gun 10. The tube 20 extends along the boom 62 and is connected therewith for taking up the forces of inertia produced during the propulsion of the stem through the tube. The forward end of the tube 20 is connected to the feed bar 63. The tube is mounted on the feed bar in such way that it projects past the feed bar a distance corresponding to the length of the tube which is intended to be inserted into the drill hole. The feed bar is forced against the rock surface such that the urging force exceeds the force of reaction acting on the tube during the propulsion of the stem. The spur on the feed bar intended to rest against the rock is mounted on the end of the piston rod of a hydraulic cylinder.

The machine works in the following manner. A hole is drilled by means of the rock drilling machine 64 in the material to be broken. The mouth of the tube 20 is then directed toward a surface in the drill hole by means of the adjusting device comprising the folding boom 62, the feed bar 63 and associated hydraulic cylinders. A fluid stemming is accelerated by means of the accelerating device (gun) 10 to a velocity which is required for causing initiation of the explosive and is directed into the pre-drilled hole.

The barrel 13 of the gun 10 shown in FIG. 1 may be inserted into the hole 12 to a varying hole depth. Venting may be carried out according to any of the manners mentioned in connection with FIG. 3.

Several experiments have been made according to the invention. In one experiment 10 gram explosive ("Dynamex") was placed in front of a stemming in form of an encapsulated water column or piston having a length of 300 mm. The hole depth was 500 mm and the water column was projected into the hole at a speed of about 250 m/s. Bench blasting was carried out where the burden was 200 mm.

In another experiment 300 mm deep holes were drilled, each spaced 400 mm from the others. Crater blasting was carried out by means of 20 gram explosive in front of a 300 mm long water column.

To advantage the invention may also be applied for obtaining delay interval breaking. By varying the length of the hose between the gun and the hole the desired delay interval is obtained. Where the burden is between 200 and 400 mm the suitable interval can be estimated to lie between 1 and 2 msec. If the velocity of the stem is 200 m/s this means that the lengths of the hoses are varied such that the step is between 0.2 and 0.4 m. The used gun may be suitably designed in common for several holes. Alternatively a separate gun can be used for each hole; in that case the guns are fired at the same time.

What we claim is:

1. A method of breaking a hard compact material, especially rock, comprising:

pre-drilling at least one hole in the material to be broken;

locating an explosive in said hole;

forming a body of substantially incompressible fluid and having a cross section area substantially corresponding to the free cross section area of said hole;

accelerating said body and directing same into said hole for impacting the explosive in said hole to initate said explosive by means of the pressure pulse which is generated in said body when same impacts the explosive; and stemming said drill hole by at least a substantial portion of said accelerated fluid body to delay leakage of blasting gases, which are generated during the explosion, out of the drill hole before the material is broken.

2. A method according to claim 1 comprising locating the explosive in the drill hole by means of said body when same is directed into the drill hole.

3. The method of claim 1 wherein said fluid is water.

4. The method of claim 3 wherein said water from said body completely fills said hole.

5. The method of claim 1 comprising compressing said explosive by contact with said body of fluid in said hole.

6. A method according to claim 1 wherein said body of fluid is of given length.

7. A method of breaking a hard compact material, especially rock, in which at least one hole (12) is pre-drilled, comprising:

accelerating a rupturable capsule (31) containing a liquid and an explosive (21) sealed therein into said hole, said liquid being outermost relative to the opening of the hole;

directing said capsule to impact a surface in said hole to initiate said explosive by means of the shock wave generated in said liquid by said impact, and to free said liquid from said capsule; and stemming said hole by at least a substantial portion of said freed liquid for stopping up said hole against leakage of blasting gases which are generated during the explosion.

8. The method of claim 7 wherein said liquid is water.

9. A method of breaking a hard compact material, especially rock, comprising pre-drilling a hole in said material;

forming a column of substantially incompressible fluid which is movable toward and into said hole;

locating an explosive adjacent the end of said column which is to first enter said hole;

accelerating and directing said column of fluid together with and preceded by said explosive into said hole to impact a surface therein to initiate said explosive said impact; and stemming said hole by at least a substantial portion of said column of fluid to delay leakage of blasting gases, which are generated during the explosion out of the drill hole before the material is broken.

10. The method of claim 9 wherein said fluid from said column completely fills said hole.

11. The method of claim 10 wherein said fluid is water.

* * * * *

UNITED STATES PATENT AND TRADEMARK OFFICE

CERTIFICATE OF CORRECTION

PATENT NO. : 4,088,368

DATED : May 9, 1978

INVENTOR(S) : ERIK VOLMAR LAVON et al

It is certified that error appears in the above-identified patent and that said Letters Patent are hereby corrected as shown below:

Column 4, line 25: replace "occurence" with ---occurrence---.

Column 4, line 29: replace "leakes" with ---leaks---.

Column 5, line 52: replace "step" with ---stem---.

Column 6, line 52 (Claim 9): after "explosive", insert ---by---.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*